United States Patent [19]

Lawrence

[11] Patent Number: 4,704,853

[45] Date of Patent: Nov. 10, 1987

[54] SPINNING OF YARN

[75] Inventor: Carl A. Lawrence, Hebden Bridge, England

[73] Assignee: National Research Development Corporation, London, England

[21] Appl. No.: 879,112

[22] PCT Filed: Sep. 20, 1985

[86] PCT No.: PCT/GB85/00436

§ 371 Date: May 20, 1986

§ 102(e) Date: May 20, 1986

[87] PCT Pub. No.: WO86/01842

PCT Pub. Date: Mar. 27, 1986

[30] Foreign Application Priority Data

Sep. 21, 1984 [GB] United Kingdom ..... 8424009
Sep. 28, 1984 [GB] United Kingdom ..... 8424490

[51] Int. Cl.[4] ..... D01H 1/135; D01H 7/898

[52] U.S. Cl. ..... 57/401; 57/408

[58] Field of Search ..... 57/5, 328, 330, 331, 57/400, 401, 408, 411

[56] References Cited

U.S. PATENT DOCUMENTS 3,845,611 11/1974 Senturk ..... 57/328 X
3,855,772 12/1974 Burlet ..... 57/328 X
4,174,605 11/1979 Pallay ..... 57/336 X
4,296,598 10/1981 Faure ..... 57/336 X
4,488,397 12/1984 Venot ..... 57/328
4,497,168 2/1985 Kamp ..... 57/401

FOREIGN PATENT DOCUMENTS 331689 8/1976 Austria .
331690 8/1976 Austria .
375097 6/1984 Austria .
1133770 11/1968 United Kingdom .
1231198 5/1971 United Kingdom .
2003513 3/1979 United Kingdom .
2042599 9/1980 United Kingdom .
2097827 11/1982 United Kingdom .

*Primary Examiner*—Donald Watkins
*Attorney, Agent, or Firm*—Cushman, Darby & Cushman

[57] ABSTRACT

Fibres are spun into yarn by being opened close to a surface (S, SD) and directed to the surface, conveniently by suction (AS) through the surface. A yarn or yarn end (Y) is twisted over the surface to have opened fibres built onto it to be spun into a twisted yarn. The surface can be a groove (GD) of included angle less than 90°. The close spacing (WS) of a means to open the fibres and the surface can be such that fibres being opened are within reach of the surface. The yarn is twisted by a twister such as a parallel-belt twister (TB1/TB2) close to but not part of the surface. Tension (T) is applied through the twister to draw off yarn.

18 Claims, 4 Drawing Figures

SPINNING OF YARN

Figure 1:
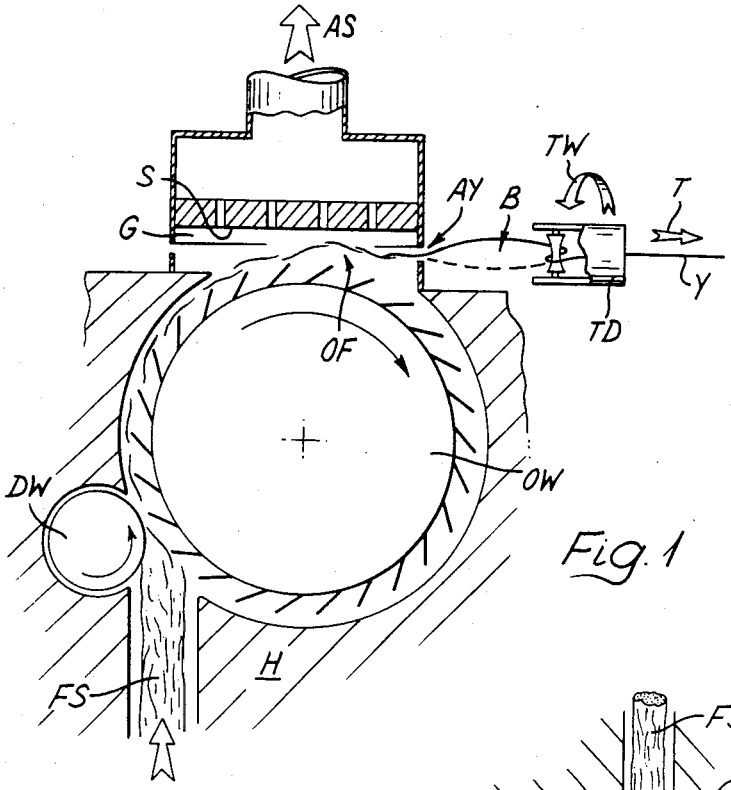

This invention relates to spinning, that is forming fibres into a yarn.

The traditional, and fundamental, actions of spinning are the provision of a band or sliver of fibres, the arranging of fibres from the band into a yarn of required size and the insertion of twist to stop the yarn from reverting to individual fibres.

Many techniques have been proposed to make spinning more efficient and these generally have both advantages and disadvantages which lead to a particular technique being preferred for a particular type of yarn or speed of production or degree of automation or other factor which is significant to the potential user.

It is an object of the invention to provide a spinning technique which uses uncomplicated, robust apparatus to spin fibres into yarn in a straightforward manner.

According to the invention there is provided a method of spinning fibres into yarn including providing a supply of fibres, providing a surface to receive opened fibres, opening the fibres close to said surface, maintaining said closeness as a defined gap, applying twist to said yarn close to but not through said surface, directing the opened fibres through said gap towards said surface immediately they are opened, positioning a yarn in said gap with respect to the surface, withdrawing the twisted yarn, building fibres directed toward the surface onto the yarn as it is withdrawn, thereby spinning fibres from said supply directly into an output yarn including a twist.

The fibres may be directed to the surface by an air flow. The air flow may be in part at least a suction exerted through the surface. The surface may be stationary or moving and may be porous.

The fibres may be directed to the surface by an electrostatic force.

The fibres may be held to the surface for building onto the yarn.

The yarn may be a yarn extending over and across the surface or a yarn beginning over the surface.

The output yarn may be wholly spun from supplied fibres or may be a core with supplied fibres spun onto it and including a twist.

The surface may be maintained within reach of fibres being opened.

According to the invention there is a spinning apparatus including means to open fibres from a supply of fibres, a surface to receive said opened fibres positioned close to the place where the fibres are opened, means to direct said opened fibres toward said surface, means to position a yarn over the surface, means separate from but close to said surface to twist the yarn, means to withdraw the yarn, from the surface through said twisting means, said opened fibres directed towards said surface being spun onto the yarn to include a twist.

There may be means to draw air through the surface to hold fibres directed toward the surface for spinning onto the yarn.

The apparatus may include a groove having an included angle of less than 90°. The groove may have an apical portion more steeply inclined than the rest of the groove.

The twister may be a parallel-belt twister.

The surface may be positioned within reach of fibres being opened.

Figure 2:
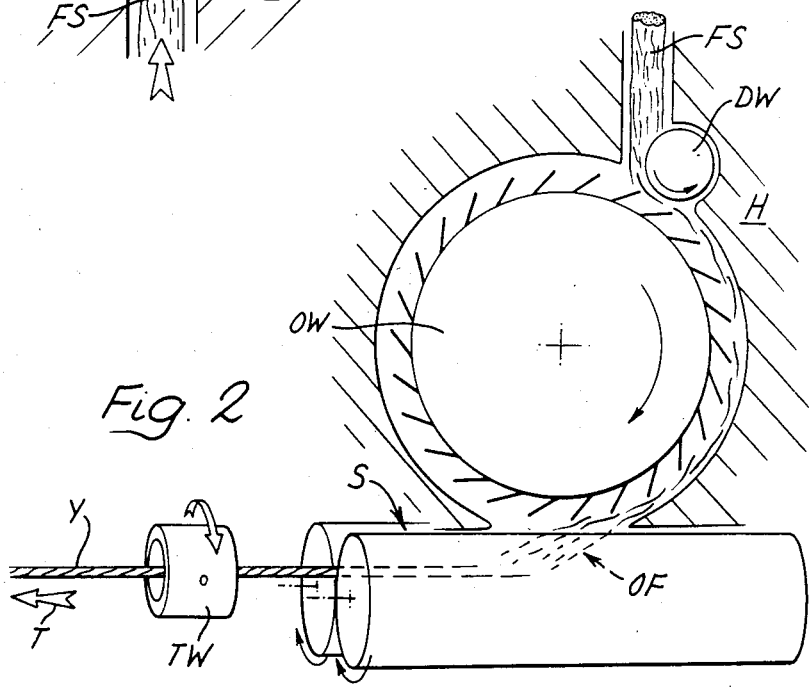
Figure 3:
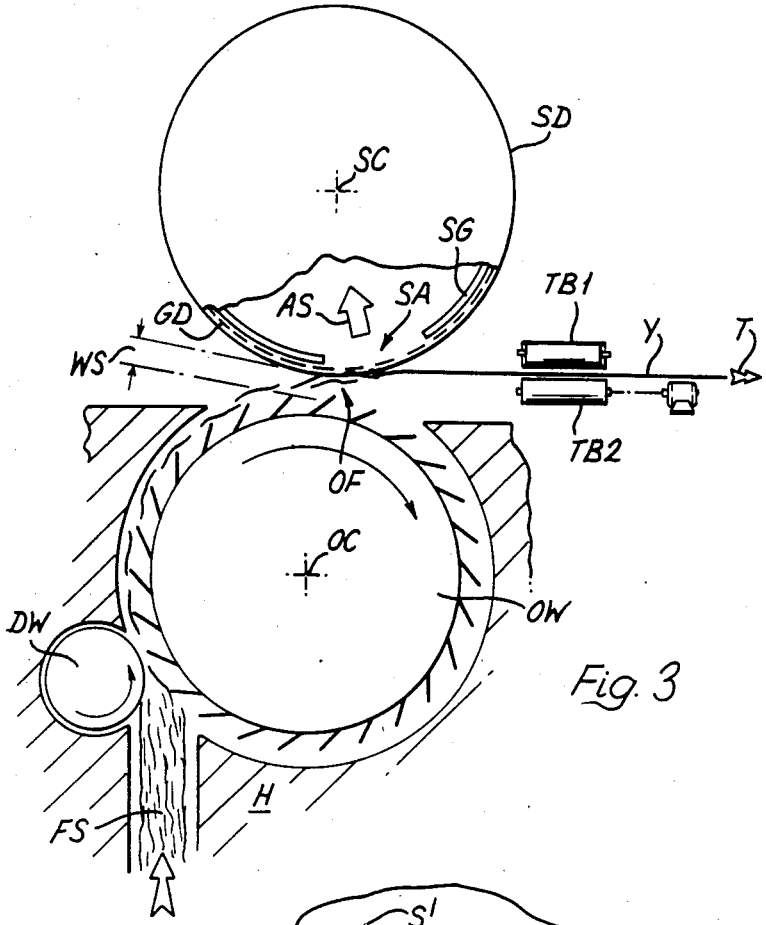
Figure 4:
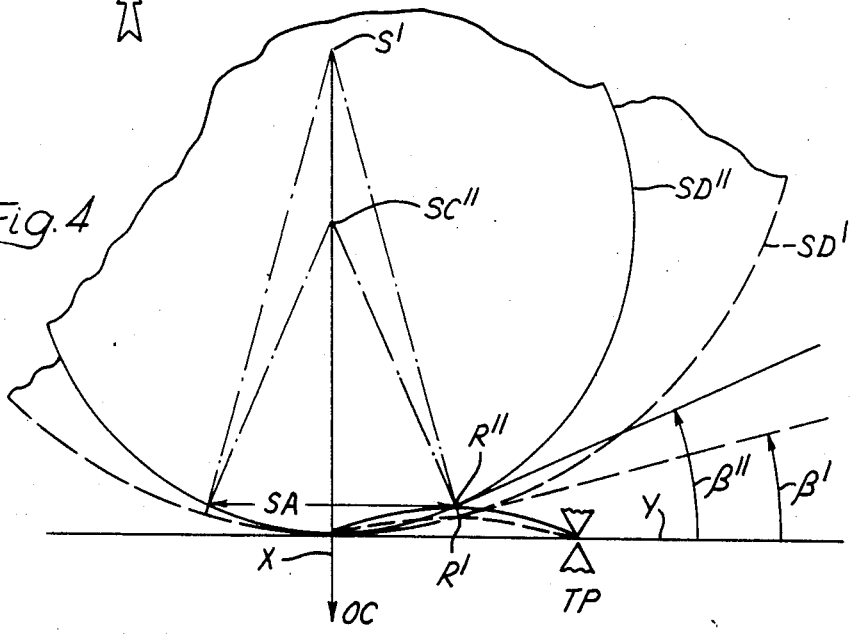

Embodiments of the invention will now be described with reference to the accompanying drawing in which:

FIGS. 1, 2 and 3 show in schematic form various forms of a spinning apparatus according to the invention, and FIG. 4 shows details of the arrangement of the spinning apparatus in FIG. 3.

In a preferred embodiment fibres are opened from a sliver in a conventional opening or separator device of a wheel fitted with angled pins and revolved rapidly in a closely conforming housing. The sliver is introduced between the housing and the rapidly moving pins at one angular position around the wheel and the opened fibres discharged from between the housing and the wheel at another angular position at a considerable speed. The fibres are discharged from the outlet of the opening wheel towards a surface close to the opening wheel through a gap in a space which is partly enclosed. A yarn is also present in the gap and is caused to twist in the space by a means outside the gap, such as a conventional false-twist device. (It is noted that a true twist is actually put into the yarn.) The closeness of the surface to the opening wheel is such that the gap is no larger than the length of the fibres. In some embodiments the gap is much less than the length of the fibres.

The opened fibres are directed towards the surface in a suitable manner, for example air drawn through the surface or electrostatic forces, and are collected on the twisting yarn to build on it as it is withdrawn by suitable take-up means beyond the twisting means applying a tension. The yarn may form a "balloon" in the small gap between the partly enclosed surface and the twisting means.

FIG. 1 shows one form of apparatus embodying the invention by which fibres have been formed into yarn.

A drive wheel DW and opener wheel OW are arranged in a housing H to receive a sliver FS of fibres. These elements are all well-known and are commercially available.

At the outlet of the opener wheel OW the opened fibres OF emerge into a space on the opposite side of which is a surface S. In a preferred embodiment surface S is in the form of a groove one wall of which is seen at G. Also in a preferred embodiment the surface S is perforated or otherwise arranged, for example from porous material, to permit a suction AS to be applied to the surface adjacent the opened fibres to act on these fibres. Other means, e.g. electrostatic forces, may be applied instead of suction, and in some cases no force need be applied from the surface, air pressure from the action of the opener wheel or a separate supply or the momentum of the fibres may be enough, the air escaping through the surface S.

By whatever means are used the opened fibres are directed through the gap towards the surface S. It may be convenient to enclose the surface as much as possible both to stabilise conditions and prevent excess air loss if air pressure or suction is used. Any enclosure must have an aperture AY for a yarn Y.

To spin fibres into yarn a yarn Y is placed near the surface S in the presence of opened fibres OF directed to the surface and the yarn is twisted and withdrawn as indicated by arrows TW and T respectively. Conveniently the twist action TW is provided by a twisting device TD mounted close to the aperture through which yarn emerges from the vicinity of surface S. Twisting device TD may be a conventional twisting element of a waisted drum free to revolve on a pin across a tube, the tube itself being revolved rapidly on its axis to twist yarn which makes a turn round the drum. The tension T is conveniently applied by a conventional winding device (not shown). To start the spinning action it may be necessary to have the starting yarn extend right across the surface initially. The yarn balloon is indicated at B.

In certain trials the following conditions applied. The yarn was taken up, and tension T applied, by a take-up means operating at 2.5 m/minute. The twisting device operated at 2250 r.p.m. The yarn was spun to about 55 tex from viscose, acrylic or cotton fibres of a staple of 30 to 40 millimeter and 1.5 denier. The opener wheel operated at about 7000 r.p.m. to produce a supply of fibres that are separate and generally straight and parallel. The suction AS was about 10 cubic meters/minute of air in a 50 millimeter duct through five slots about 0.5 mm×10 mm at least one of which acts on the groove G. The twisting device TD was placed to have its entry about 12 millimeters from the surface S, along the yarn. The twisting device is believed to be more effective the closer it is to the surface S but for practical reasons 10 to 12 millimeters is the closest spacing yet used.

Also as mentioned above the gap between the outlet of the opening wheel or other opening device is no greater than the length of the fibres and often much less. This is in distinction from earlier spinning arrangements in which the opened fibres are conveyed in ducts and the like by air blasts. In the present invention the yarn being spun is so close to the outlet for opened fibres that fibres can move bodily sideways a short distance and be included in the spinning yarn or move along their length from the opening device outlet through a gap shorter than their length.

In other trials similar acrylic staple was spun to 15 to 20 tex yarn using a take-up speed of 2 meters/minute with a sliver feed rate of 0.65 meters/minute and 1600 r.p.m. twisting.

The yarn "balloons" between the surface and the twister but this may not necessarily be an adverse action, as it is believed to improve the yarn in some cases.

In other trials various changes have been made and the apparatus still produced yarn. The form of surface S may be changed. In one embodiment a "BOBTEX" (RTPO rotor-disc has been used as the surface S, with suction applied. In another embodiment surface S can be caused to move. In this embodiment the surface is formed by a disc rotated about an axis perpendicular to the disc, which axis lies in the plane of the drawing, again with suction applied. The yarn can be a core yarn drawn right through the apparatus to have fibres spun onto it as a twisted cover. Surface S may be flat or grooved.

In a further embodiment, outlined in FIG. 2 with similar references to those in FIG. 1, a moving surface S is formed by one perforated drum rotated close to the opener wheel or two perforated drums each rotated about a respective axis perpendicular to the axis of the opener wheel and suction is also applied through surface S. When two drums are used they are rotated as shown by the arrows. Again means away from the surface, such as the twister TW and a take up means, not shown, are used to twist the yarn which is over the surface S and apply tension T.

FIG. 3 shows another embodiment of the invention. In this embodiment a device having some similarities to the "BOBTEX" (RTM) rotor disc is used as the surface S. A "BOBTEX" (RTM) rotor disc has the general form of a simple pulley, that is a thin circular body with a shallow groove around the periphery. The groove has thin slots cut across the bottom of the groove, usually at an angle to the length of the groove. Part of the inside of the disc is cut away so that suction can be applied through the slots to material in the groove. The disc can be rotated and the suction is applied over only a part, say about one-fifth or less, of the periphery by a suitable duct. All this general arrangement is well-known in the art. However it has now been found that instead of the very flat and open groove of the "BOBTEX" disc a much narrower and deeper V-form groove can be used as the surface S and the disc can be rotated. Furthermore instead of the waisted drum twister described above a modified texturing belt twister is used. As shown in FIG. 3 the same spatial relationship of the surface and the twister to the opening wheel is used, that is to say the surface is close to the outlet of the opening wheel and the twister is close to the region between the disc and the opening wheel outlet. As shown in FIG. 3 the belt twister does not have the belts crossing at an angle, as is the practice in the art, but the belts are parallel and the yarn passes between the belts substantially at right angles to the movement of the belts. It is well-known in the texturing art that when belt twisters with belts crossing at an angle are used a high tension, some 50 to 100 grams, has to be applied to draw the yarn through against the high friction of the twisting action by using parallel belts it has been found that a tension of one-tenth or less of the accepted value, i.e. some 5 grams, is adequate to draw the yarn through.

FIG. 3 is now considered in more detail. Parts having a reference similar to that in another Figure are similar, even if not identical. The opening arrangmeent of an opening wheel OW and a drive wheel DW is as mentioned above are well-known in the art. The surface referred to a S above is again in the form of a groove but this groove GD is formed in the surface of a disc SD, which can be rotated if required. The groove GD is provided with slots, as described above, but these are too small to be shown in the Figure. The inside of disc SD is hollowed out so that suction, AS, can be applied through the slots in the groove GD. A suction guide SG, conveniently in the form of an apertured ring inside the disc SD, determines the position and length of the part of the groove GD subject to suction AS. Suitable arrangements to couple means to apply suction AS are well-known in the art and are not described further, apart from certain required features when appropriate. The centre of rotation of opener wheel OW is shown at OC and that of disc SD is shown at SC. No structure supporting disc SD or other parts is shown, any suitable form can be used and will be apparent to those skilled in the art.

The form of the groove GD is completely distinct from that of a "BOBTEX" (RTM) wheel which has a wide, shallow trough with an included angle of some 150°. In the discs used for embodiments of the invention the included angle is some 90° or less, ranging down to 30°. The narrower angles are believed to be more effective as the fibres forming the yarn can be compacted into the point of the "V" form of the groove improving the yarn spinning action. Advantageously the V-groove can have a point region more steeply angled than the main part of the groove, as shown in the extended enlarged section in FIG 3. The disc SD is conveniently some 60 to 140 millimeters in diameter and 20 to 30 millimeters thick. The mouth of the groove extends over most of the thickness and, depending on groove geometry, the groove is some 10 millimeters deep. The area of the groove cross-section is also significant. A value of between 2.5 and 3 square millimeters is appropriate with 2.8 square millimeters a preferred value at all included angles. The slots for the suction to act through onto the groove is as closely spaced as possible, for example on every millimeter or closer. The suction guide SG can be arranged to define an aperture of specific width and length. Too narrower too short an aperture prevents spinning. Too long an aperture could cause problems, apart from increased air consumption, if the aperture is much longer than the fibres being spun. The disc SD may be revolved so its construction should be of precision-quality for this reason and because consistent dimension and form of the groove can be important in controlling spinning quality even when the disc is not moved.

The form and position of the twister is now considered. As mentioned above a twister having some similarity to conventional texturing belts is used but significantly modified. Firstly the belts are run parallel instead of crossed. FIG. 3 shows the belt twister cut through with the rollers at one end and the upper and lower belts in cross-section, being parallel to each other and at right angles to the path of yarn Y. An important difference from conventional belt twisters is the low friction achieved so the tension T to drawn the yarn Y through is reduced by a factor of ten or more. Secondly a different form of belt may be used partly to lower friction still more while maintaining drive by using a resilient material which can "wrap-around" the yarn more than existing materials.

The geometry of the arrangement in FIG. 3 is now considered with reference to FIG. 4. This latter Figure shows in schematic form the effect of different sizes of disc SD, and other factors, on the path of the yarn between the region of the surface where it is fomred and the position of the twister of whatever type, indicated at TP. The distance WS between the opening wheel and the surface where yarn is formed is one variable, another is the displacement of centre SC with respect to centre OC for a given distance WS. The size of the outlet from the opening wheel can also be significant.

Experiments have shown that with fibres of 30 to 40 millimeter staple and 1.5 denier of various materials some dimensions are more critical than others. Appropriate dimensions are now discussed.

Firstly the distance WS. Dimensions between about 6 and 40 millimeters have been used to produce yarn. A dimension of around 10 millimeters produces useful yarn. Increasing or decreasing the dimension alters the behaviour of the opened fibres and increases fibre loss. It is believed that while short fibres can emerge bodily from the opening wheel outlet and be taken up on surface S longer fibres under certain conditions remain on the opening wheel at least past the outlet and may even go round again before being removed. This effect favours short fibres and can weaken the yarn. As dimension WS is increased it is necessary to increase the suction AS to maintain removal of the longer fibres. WS can be 20 to 30 millimeters, with appropriate fibe length, and produce useful yarn. Increase in suction will increase the force holding the assembled yarn in the groove G in surface S, or in the groove GD, and may require an increase in the twisting action. The size of the outlet from the opening wheel can be altered but too large an outlet could cause other problems.

When the disc SD is used the disc can be moved to different positions above the outlet of the opening wheel as well as having a different dimension WS. This alters the relationship with the edge of the outlet and can alter the ease with which fibres are sucked into the disc. Also the suction guide SG can be rotated. In one arrangement the disc SD was positioned so that the line of centres OC to SC went through the middle of the opening wheel outlet and the guide SG was arranged with the aperture SA symmetrically disposed about the line of centres and satisfactory yarn was produced. However yarn can also be produced with offset arrangements such as those shown in FIG. 3.

From high-speed cinematography it is believed that the trailing end of a fibre on the opening wheel is drawn away first, by the suction, toward the disc and the leading end leaves the wheel later. Longer fibres may thus not be detached from the wheel before they move past the outlet. Clearly the direction in which the yarn is drawn from the surface S can affect the operation. When the yarn is drawn off against the direction of the opening wheel better results are sometimes obtained. This may be because the fibres now approach the apex of the cone of the forming yarn along the length of the fibre and there is not any tendency to wrap around the yarn as may occur in the yarn direction shown where fibres could have a U-shape as they approach the forming yarn or otherwise become wrapped around the yarn instead of being properly spun together.

As mentioned above the disc SD can be rotated. Such rotation increases the yarn strength and reduces the "hairyness" but can cause variations in thickness as almost regular thick and thin places along the yarn. Disc speeds of up to 160 r.p.m produce such effects. High speed cinematography again reveals a possible reason. When the groove in the disc is wide and shallow a loose web of fibres can build up as the fibre ends are drawn into the slots by the suction. From time to time the loose web is caught up by the forming yarn and a thick place is formed. For this reason the grooves of included angle of 90° or less are used.

FIG. 4 shows possible paths of the yarn leaving the disc SD. As shown in FIGS. 1 to 3 the yarn Y is drawn along a tangent from point X through twister position TP and then to a take-up device. In practice the suction would bend the yarn between X and TP to the full line curve. The action of a twister at TP causes the yarn to "balloon". It is believed that this can cause intermittent end breaks particularly as yarn speed increases. It is possible to reduce "ballooning" by reducing the angle $\beta$ ($\beta'$ or $\beta''$) and aligning the yarn with or near to the tangent at points R (R' or R''). This can be done, for example, by moving the twister position or by enlarging the disc from the radius SC''-X to the radius SC'-X (say from 35 to 60 millimeters).

A further important factor is the suction, AS, applied to draw and hold fibres to be spun into yarn. A vacuum of between 5 and 30 inches of water gauge and air flows of some 5 to 10 cubic feet per minute produce spinning of yarn. The stability of the vacuum and airflow with changing conditions at the surface S or GD as fibres accumulate and are removed is believed to be of significance in the quality of yarn produced. The use of the parallel-belt twister is helpful in providing the high "loss" of twist from the end of the yarn needed to spin the fibres into the forming yarn in a satisfactory manner. The twist is best introduced as near as possible to the yarn formation point so that a "stiff" connection for the propagation of twist to the forming yarn is achieved. It is believed that a certain amount of twist must be present at the spinning surface to produce useful yarn. As spinning speed increases the twisting speed must also increase to sustain the minimum.

The embodiments using disc SD and the belt twister TB1/TB2 produce yarn at speed of up to 80 meters/minute. The belt twister is operated so the ratio of belt speed to yarn speed is in the order of 3 to 5. 80 tex yarn with strength of 200 to 400 grams can be produced. Fine count long fibres, say up to 50 millimeters, are used.

Yarn, whether core or not, can be spun from either direction, i.e. in the sense of the opener wheel rotation or opposite to this rotation. It is believed that when spun in the opposite direction, i.e. not as shown in the drawing, a better yarn can be obtained.

While the exact action of building the opened fibres onto the yarn drawn over the surface is not known yarn can be produced at a range of speeds and conditions from various materials. The separation of the twisting action from the space where the opened fibres are in directed motion is believed to be very significant in the production of the yarn. The closeness of the outlet of the opening device to the spinning yarn is also significant.

The above and other trials have indicated that the speed of the twister can be varied over a range for any particular supply of fibres and without reference to any speed of rotation of surface S. This independence between the speed of the twister and any other motion where the fibres are spun into the yarn by providing an additional variable in the spinning process which flexibility in the process provides the spinner with better control of the properties of the yarn spun and more freedom to respond to variations in and different types of raw material.

The details of operating conditions and shapes of the elements of the apparatus are given by way of example only.

I claim:

1. A method of spinning fibers into yarn including
providing a supply of fibres,
providing a surface to receive opened fibres,
opening the fibres close to said surface, maintaining said closeness as a defined gap with the surface within reach of fibers being opened,
directing the opening fibers through said gap towards said surface immediately they are opened,
positioning a yarn in said gap with respect to the surface,
applying twist to said yarn close to but not through said surface,
withdrawing the twisted yarn, building fibres directed toward the surface onto the yarn as it is withdrawn,
thereby spinning fibres from said supply directly into an output yarn including a twist.

2. A method according to claim 1 including directing the fibres to the surface by an air flow.

3. A method according to claim 2 including exerting the air flow in part at least as a suction through the surface.

4. A method according to claim 3 including providing the surface as a groove with an included angle of less than 90°.

5. A method according to claim 4 in which the groove has an apical portion more steeply inclined than the rest of the groove.

6. A method according to claim 1 including one of holding the surface stationary and moving the surface.

7. A method according to claim 1 including directing the fibres to the surface by an electrostatic force.

8. A method according to claim 1 including holding the fibres to the surface for building on a core yarn.

9. A method according to claim 1 or any dependent claim including one of extending the yarn over and across the surface as a core and beginning the yarn over the surface.

10. A method according to claim 1 including applying said twist with a low friction parallel-belt twister.

11. A spinning apparatus including means to open fibres from a supply of fibres, a surface to receive said opened fibres positioned close to the place where the fibres are opened and within reach by the fibres as opened, means to direct said opened fibres toward said surface, means to position a yarn over the surface, means separate from but close to said surface to twist the yarn, means to withdraw the yarn, from the surface through said twisting means, said opened fibres directed towards said surface being spun onto the yarn to include a twist.

12. Apparatus according to claim 10 including means to draw air through the surface to hold fibres directed toward the surface for spinning onto the yarn.

13. Apparatus according to claim 12 in which the surface is a groove having an included angle of less than 90° and having an apical portion more steeply inclined than the rest of the groove.

14. Apparatus according to claim 12 in which the surface is a groove formed in a curved face of a body.

15. Apparatus according to claim 14 in which the curved face is the periphery of a disc.

16. Apparatus according to claim 12 in which the twisting means is a low friction parallel-belt twister.

17. Apparauts according to claim 12 in which the surface is between 6 and 40 millimetres from the place where the fibes are opened.

18. Apparatus according to claim 12 in which the twisting means is 10 millimetres or more from the surface.

* * * * *